United States Patent [19]

Glaser

[11] 4,422,014

[45] Dec. 20, 1983

[54] METHOD AND APPARATUS FOR OBTAINING A FOCUSABLE BEAM OF ELECTRONS FROM A GASEOUS HOLLOW-CATHODE DISCHARGE

[76] Inventor: David Glaser, 1918 Raymond Dr., Northbrook, Ill. 60062

[21] Appl. No.: 320,325

[22] Filed: Nov. 12, 1981

[51] Int. Cl.[3] ..... H05B 37/00

[52] U.S. Cl. ..... 315/169.4; 313/595

[58] Field of Search ..... 313/595, 597, 598, 599, 313/600, 604, 606, 609, 620; 315/169.3, 169.4; 340/775

[56] References Cited

U.S. PATENT DOCUMENTS

| | | | |
|---|---|---|---|
| 3,921,021 | 11/1975 | Glaser et al. | 315/169.4 |
| 4,147,959 | 4/1979 | Bonn | 315/169.4 |
| 4,229,766 | 10/1980 | Sipos | 315/169.4 |

*Primary Examiner*—David K. Moore
*Assistant Examiner*—Robert E. Wise
*Attorney, Agent, or Firm*—Edmond T. Patnaude

[57] ABSTRACT

A flat-panel display employs an electronic focusing system which utilizes a repeller anode to repel low energy electrons emitted from a gas-discharge plasma which is controllably moved across a generally planar array of hollow-cathode elements.

20 Claims, 6 Drawing Figures

METHOD AND APPARATUS FOR OBTAINING A FOCUSABLE BEAM OF ELECTRONS FROM A GASEOUS HOLLOW-CATHODE DISCHARGE

The present invention relates in general to the art of electron-beam generation from a gaseous discharge within a hollow cathode, and it relates in particular to a new and improved method and apparatus for generating a narrow electron beam which moves laterally across a planar array of hollow-cathode elements.

BACKGROUND OF THE INVENTION

Cathodoluminescent flat-panel displays of the type in which a screen made up of a plurality of discrete elements of a luminescent material such as phosphor is scanned by an electron beam to illuminate selected areas of the screen at controlled intensities are well known. Moreover, the use of a gas discharge within a hollow cathode to provide a source of electrons for such displays is also well known. See, for example, U.S. Pat. No. 3,999,094 which discloses a panel display utilizing a hollow cathode.

U.S. Pat. No. 3,742,483 discloses a display panel using a planar array of small dot-like gas-filled cells arranged in rows and columns and which are caused to glow selectively to provide a source of light which moves across the array of cells.

SUMMARY OF THE INVENTION

Briefly, in accordance with the present invention there is provided a generally planar cathode in the form of an array of hollow-cathode elements comprising a plurality of elongated cathode sections in the form of open-top channels arranged in side-by-side parallel relationship in proximity to a planar, electron-transmissive extractor electrode extending across the tops of the cathode channels A gas discharge initiated in one end of one cathode channel is controllably moved along the channel to the other end thereof whereby the effective source of electrons migrates from one end of the cathode channel to the other. A raster comprising a plurality of horizontal rows is provided by sequentially repeating this procedure for each channel. The relatively large, indiscrete cloud of electrons thus emitted from the gas discharge within the cathode and which passes through the extractor electrode is focused into a narrow, discrete beam of electrons by means of an electron-transmissive repeller electrode mounted in proximity to the extractor electrode and maintained at a potential which is positive relative to the cathode but less than that of the extractor electrode. The extractor and repeller electrodes are spaced from the cathode by distances substantially less than the mean free path of the electrons, say one-tenth thereof. By properly selecting the voltages of the extractor and repeller electrodes, only those electrons which are emitted from the most space-efficient area of the cathode and whose directional vectors are substantially perpendicular to the repeller electrode have the necessary velocity or energy to pass through the repeller electrode. Those electrons which are released from the less efficient areas of the cathode or which travel in directions which are vectored well away from the perpendicular are repelled. Consequently, as the gas-discharge free-electron source travels sequentially along each cathode channel, the narrow, discrete beam of electrons transmitted by the repeller electrode may be made to move laterally, line by line for scanning a display screen. If desired, the beam can be made to move across one channel and back another channel, or all channels can be activated at the same time.

The electron beam transmitted by the repeller electrode can be modulated with video or other information to be displayed, and the modulated beam or beams then accelerated before impinging on the luminescent elements of a suitable target or display screen. Preferred ways in which the electron beam or beams may be modulated and accelerated in a flat-panel display are described in my copending applications serial numbers 232,972 and 320,324 filed respectively on Feb. 9, 1981 and Nov. 12, 1981. A preferred manner of constructing the cathode assembly is described in my copending application serial number.

GENERAL DESCRIPTION OF THE DRAWINGS

The present invention will be better understood by a reading of the following detailed description taken in connection with the accompanying drawings wherein.

DETAILED DESCRIPTION OF THE INVENTION

In the following description of a preferred embodiment of the invention the manner in which the electrode structure is housed and the low-pressure ionizable atmosphere provided within the housing is not described in detail inasmuch as it does not constitute a part of the present invention. Preferably, however, the electrode structure of the invention is incorporated in a flat-panel display constructed in accordance with the teachings of copending applications Ser. Nos. 51,152 filed June 22, 1979, now U.S. Pat. No. 4,303,843, and 182,782 filed Aug. 29, 1980, now U.S. Pat. No. 4,339,482. The use of this panel construction is possible because the present invention may be carried out using electrodes which are compliant and can, therefore, conform to the front glass pane so as not to establish stresses in the glass pane. The atmosphere within the panel is essentially an inert ionizable gas or a mixture of noble gasses such as neon or helium and has a pressure in the range of 0.5 to 15 Torr.

Figure 1:
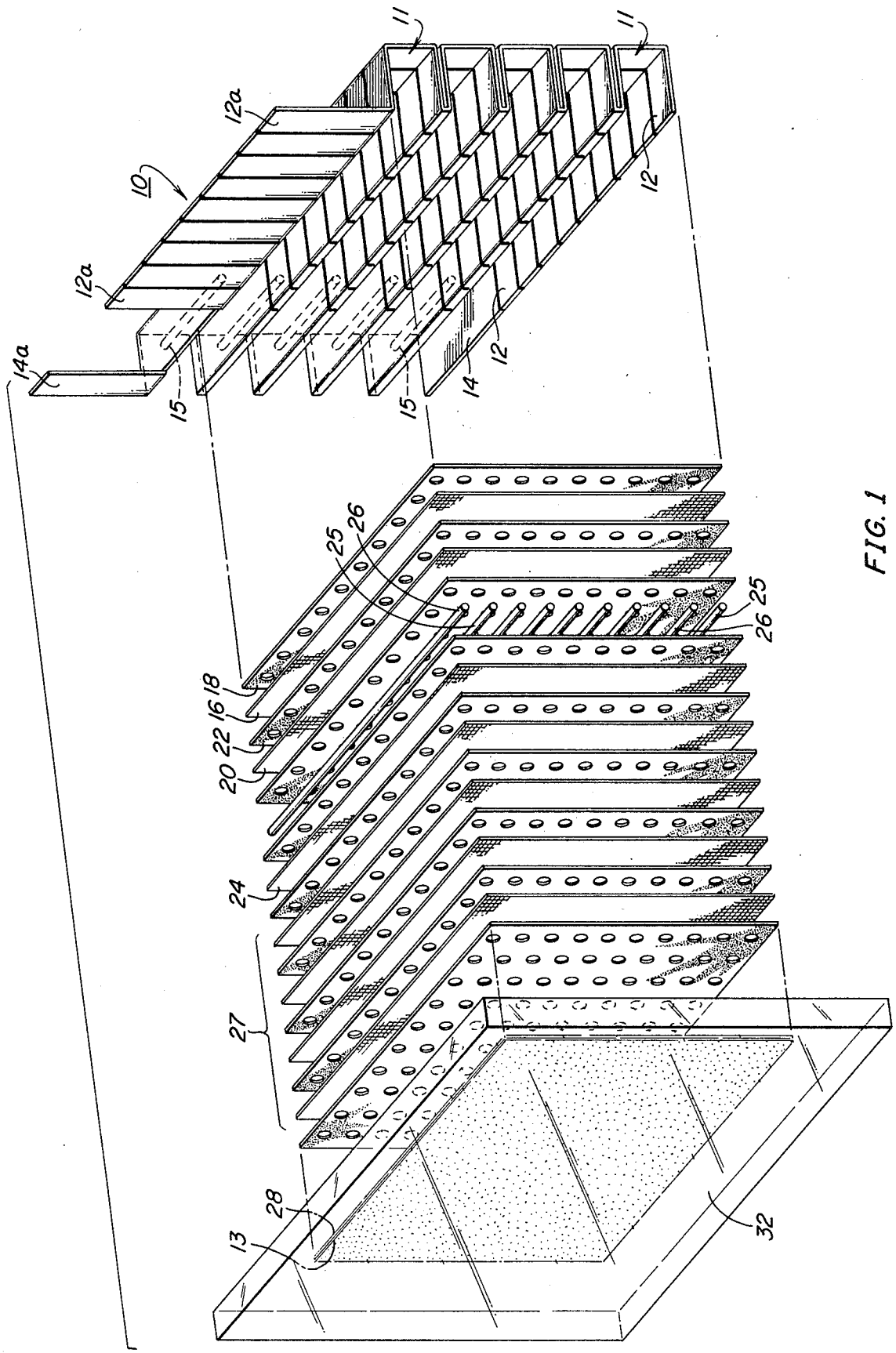
FIG. 1 is an exploded, perspective view of a portion of a flat-panel display embodying the present invention.
Figure 2:
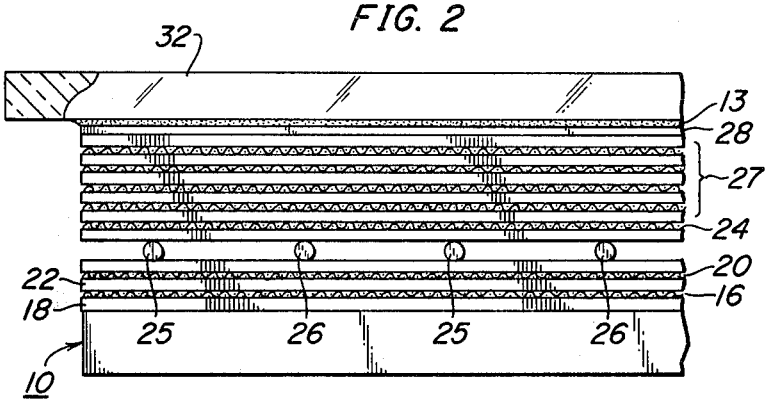
FIG. 2 is a cross-sectional side view of the flat-panel display shown in FIG. 1.

Referring particularly to FIG. 1, a generally planar cathode assembly 10 comprises a plurality of hollow-cathode channels 11 arranged in side-by-side parallel relationship in a plurality of parallel, horizontal rows. Each of the channels 11 is formed by a plurality of mutually insulated, channel segments 12 extending perpendicularly to the longitudinal axes of the channels 11. When used in a television display the number of channel segments 12 may be equal to or greater than the number of columns of phosphor elements in the display screen, and the number of channels may be equal to the number of rows in the display. Preferably, however, one channel 11 is provided for each two adjacent horizontal rows to be scanned thereby enabling the use of a lower pressure within the panel. Also, and as more fully described hereinafter, each of the segments 12 is common to all of the channels 11 and includes a terminal portion or tab 12*a* at the top which is adapted to be connected to a suitable switching circuit for controllably connecting operating voltages to the channel cathode segments 12.

In order to facilitate an understanding of this invention and permit an illustration thereof, the cathode is shown as having five horizontal channels 11 and ten vertical segments 12 for scanning a display screen or target 13 having ten rows and ten columns of illuminescent elements (not visible in the drawing). However, where the invention is incorporated in a television display panel the width of each segment 12 may be the size of a single pixel or less and the number of channels may be equal to one-half the number of rows to be scanned.

Each hollow-cathode channel 11 includes a glow-discharge initiating or starter section at one end, the rear end as shown in FIG. 1, which section is defined by a single, elongated channel segment 14 having a terminal tab 14*a* at the top. The channel length of the segment 14 is not critical, but the segment 14 must be highly space-efficient to assure the fast and reliable initiation of a gas discharge therein. Satisfactory operation has been achieved wherein the starter section has a length equal to about that of ten of the segments 12. A plurality of starter anodes in the form of wires 15 extend into the channel-defining portions of the starter cathode segments 14 and the voltages on the wires 15 are selectively raised to initiate negative glow discharges in the respective cathode channels, If desired, other suitable means for initiating the gas discharges such as injection of a primary discharge at one end of the cathode channels may be used.

Figure 3:
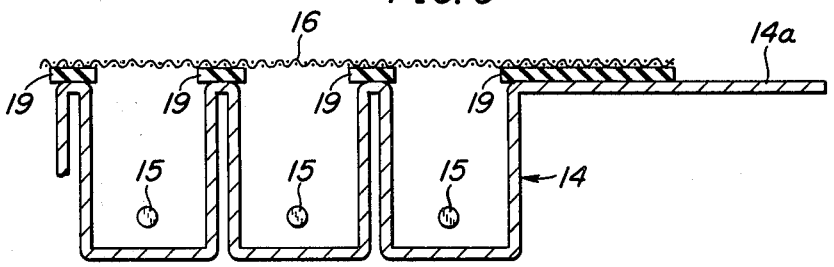
FIG. 3 is a cross-sectional view showing an alternative embodiment of the invention.

Mounted across the open tops of the cathode channels in coplanar relationship with the overall cathode is a vertically disposed electron-transmissive extractor electrode 16. The electrode 16 must be insulated from the cathode and is maintained at a positive potential of about a few hundred volts relative to the cathode to provide a undirectional electric field which draws free electrons from the plasma in the gas discharges within the cathode channels and sustains the gas discharges therein. The electrode 16 may be of any suitable construction such as a fine mesh metal screen or a perforated metal foil having rows and columns of holes in registry with the luminescent elements on the target screen 13. The electrode 16 may be insulated from the cathode by an electron-transmissive perforated sheet 18 of insulating material having holes therethrough aligned with the luminescent elements in the target screen. Alternatively, the electrode 16 may be insulated from the cathode by means of insulating strips 19 as shown in FIG. 3, or by any other suitable means.

In order to provide an electron beam having a sharply defined, discrete cross-sectional area for bombarding the target screen, an electron-transmissive repeller electrode 20 is mounted in spaced, coplanar relationship with the extractor electrode 16. The repeller electrode may be of any suitable construction including a finely perforated metal sheet having rows and columns of holes aligned with those in the electrode 16, but preferably it is a fine mesh metal screen. A thin, electron-transmissive perforated sheet 22 of insulating material is positioned between the electrodes 16 and 20. This sheet 22 may be provided with holes which are in registry with the luminescent elements on the target screen 1, but preferably it is simply a plurality of insulating strips as shown at 19 in FIG. 3.

The repeller electrode 20 is connected to a source of dc voltage which maintains it at a positive potential relative to the cathode but at a potential of about one hundred volts less than that of the extractor electrode. As explained more fully hereinafter, by properly selecting the voltages on the extractor and repeller electrodes the electrode 20 repels those electrons which have passed through the extractor electrode but do not have more than a predetermined energy level in a direction perpendicular to the plane of the electrode 20. As a consequence, only those electrons which emanate from the most space-efficient area of the cathode are transmitted by the repeller electrode 20, which area will be in the central region of the gas discharge in the cathode channels.

Inasmuch as two rows of holes overlie each cathode channel two sharply defined, discrete beams of electrons are transmitted by the repeller electrode 20. In order to permit only one of these two electron beams to pass through a modulating grid 24 wherein its intensity is varied in accordance with the information to be displayed, a pair of beam suppressor electrodes in the form of wires 25 and 26 is provided for each cathode channel 11, and these electrodes are insulated from the adjacent electrodes 20 and 24 by sheets of insulation having rows and columns of holes aligned with the luminescent elements on the target screen. As shown, each electrode 25, 26 is a wire which is in proximity to one row of holes so that when one of the suppressor electrodes is at ground potential or other suitably low voltage and the other is at a suitably positive potential, transmission of the electron beam associated with the grounded electrode is prevented and only the other beam from the common cathode channel will reach the modulating grid 24.

In a television display the voltage on the grid 24 will vary in proportion to the video signal. The discrete beam of electrons which is thus transmitted by the repeller electrode 20 and modulated by the video signal then passes through a plurality of mutually insulated electron transmissive accelerator electrodes 27 separated by sheets of insulation having rows and columns of holes therethrough in registry with the luminescent elements on the target screen 1. The beam of accelerated electrons then passes through a high voltage electron-transmissive ultor electrode 28 and impinges on a sharply defined discrete area of the display screen or target 12. The target is mounted against a glass pane 32 and may be screened thereon. The accelerating electrodes 27 and the ultor electrode 28 have successively higher voltage levels with the electrode 28 having a voltage of say 5000 volts. As noted above, all of the sheets of insulation separating the several electrodes 16, 20, 24, 25, 26, 27 and 28 preferably have rows and columns of holes wich are in registry with luminescent phosphor dots on the target 13. As more fully described in my copending application Ser. No. 232,972 filed Feb. 9, 1981, now U.S. Pat. No. 4,393,334, these holes are preferably tiny elongated slots to effectively increase the allowable Pd of the system without actually increasing the pressure in the panel or the spacing between the elements.

OPERATION

In operation, an electron beam may be generated and caused to scan the luminescent elements or lines on the screen 13 row by row to provide a conventional raster of parallel rows. The intensity of the electron beam may be modulated by a video voltage signal applied to the electrode 24 so that a picture corresponding to the video signal will be visible through the viewing area of the glass pane 32. The invention may be used in either a black and white or a color television display.

Figure 4:
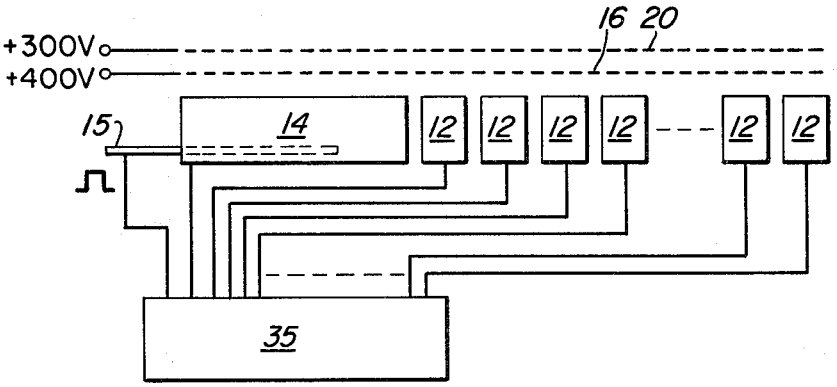
FIG. 4 is a schematic, cross-sectional view of a portion of the device of FIG. 1 and associated control circuit.

With reference to FIGS. 1, 3 and 4, a negative glow discharge may be initiated at the upper left-hand corner of the display and thus in the first or uppermost cathode channel 11 by applying a positive voltage pulse of the order of 600 volts to the starter wire 15 which extends into the starter segment 14 of the uppermost channel. At this time the segment 14 is connected to ground through a switching circuit 35 wherefor a negative glow discharge is initiated within the section of the cathode channel defined by the uppermost starter segment 14. Also at this time the group of the next five adjacent cathode segments 12 are also connected to ground wherefor the gas discharge initiated in the segment 14 quickly moves into the space within these five cathode segments. The segment 12 next to the active group of segments is at a positive voltage which will not support a gas discharge wherefor the gas discharge is confined to the space within the first group. Inasmuch as the positive voltage on the extractor electrode is sufficient to sustain the gas discharge once it has been started, the gas discharge may be initiated by a positive voltage pulse of short duration applied to the starter wire 15 by the control circuit 35.

In order to cause the glow discharge to move from one end of the channel to the other, the voltages on the segments 12 are sequentially lowered and raised so that only a select group of adjacent segments can support a gas discharge. While the number of segments in the active group is not critical, I have found that good results can be obtained using five segments in the active group. Assuming, therefore, a group of five active segments in which the discharge is initially confined, the voltage on the sixth segment is lowered and the voltage on the first segment is simultaneously raised wherefor the active group will be the second through the sixth segments causing the gas-discharge to move along the channel a distance equal to the width of one segment 12. The voltage on the seventh segment is then lowered and the voltage on the second segment is simultaneously raised. This sequence is continued until the gas discharge is contained within the last five segments at the end of the line being scanned. It may be seen that an inherent advantage of this system is the fact that the rate at which each segment 12 is pulsed is equal to the scanning rate divided by the number of segments in the active group.

When the gas discharge has moved to the end of the cathode channel and is contained within the group of segments at the end of a cathode channel, the voltages on these segments are raised so as to extinguish the gas discharge, and a starter pulse is then applied to the starter wire 15 in the next cathode channel to be activated. In the case of a television display, a delay equal to the length of a horizontal blanking pulse will be provided between the extinguishing of the glow in one channel and the initating of a glow in the next channel.

It may thus be seen that the relatively large gas-discharge plasma, say two-by-five pixels in cross-section, scans the cathode row-by-row. The repeller electrode effectively focuses or collimates the electrons which are extracted from this plasma into two narrow sharply defined beams of electrons each having a minimum velocity or energy level. One of these beams is suppressed by one or the other of the associated electrodes 25, 26 and the unsuppressed beam is then modulated and accelerated before impinging on the luminescent target or display screen.

Figure 5:
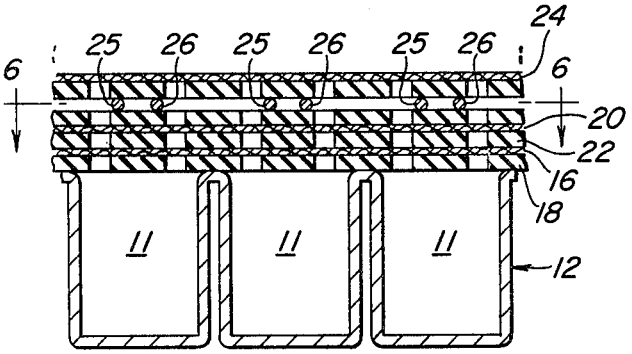
FIG. 5 is a cross-sectional view of a portion of the display shown in FIGS. 1 and 2.
Figure 6:
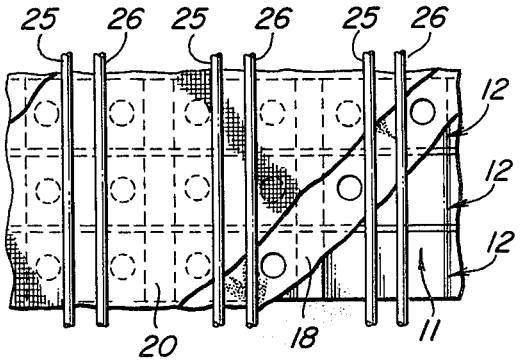
FIG. 6 is a cross-sectional view taken along the line 6—6 of FIG. 5.

In order to use one cathode channel for each two adjacent rows to be scanned, it is necessary to utilize only the electrons emanating from symmetrically disposed sections of the gas discharge on one side or the other of the cathode channel. With reference to FIGS. 5 and 6 it may be seen that the wires 25 and 26 in each set are equally spaced from the respective side walls of the associated cathode channel. As described above the two electrode wires 25 and 26 which extend parallel to the associated cathode channel 11 are respectively positioned in alignment with one of the two rows of holes in the insulator 18 overlying the associated channel. The wire 25 or 26 thus aligned with the row of luminescent elements not being scanned is held at a low potential to repel the electrons in the unwanted beam wherefor only the desired row of luminescent elements is scanned. The wires 25 and 26 are preferably located between the repeller electrode 20 and the video grid 24, but they can be positioned anywhere between the cathode and the display screen. If desired, however, the number of cathode channels can be made equal to the number of rows to be scanned, wherefore the wires 25 and 26 can be eliminated.

In the embodiment described the display is scanned row by row, with each row being scanned from left to right. In an alternate embodiment which may have advantages in some applications a beam or group of beams may be started at the beginning of a TV field and scanned left to right. The glow may then be transferred to the next line of cathodes, if the display is interlaced, and scanned right to left. If the display is not interlaced, the glow may simply be scanned back down the same channel, with the potentials of electrodes 25 and 26 altered so that the next line down on the luminescent screen is activated. This general method of scanning is shown in U.S. Pat. Nos. 3,701,924 and 3,846,669 and is also shown in modified form in copending Application Ser. No. 161,504, filed June 20, 1980 by De Jule and assigned to the same assignee as is the present invention.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed is:

1. A method of exciting a luminescent target with a beam of electrons, comprising the steps of providing a source of free electrons, accelerating said electrons from said source toward said target by means of an electron-transmissive, positively charged electrode, and selectively repelling back to said electrode electrons transmitted by said electrode having less than a predetermined vector energy level.

2. A method according to claim 1 comprising the step of causing said source to move laterally to scan said target with the electrons which are transmitted by said electrode and have vector energy levels exceeding said predetermined energy level.

3. A method according to claim 1 comprising the step of establishing a gas discharge in the space defined by a hollow cathode to provide said source of free electrons, said gas discharge being moved within said hollow cathode to scan said target.

4. A method according to claim 3 wherein said step of selectively repelling is carried out by positioning a positively charged electron-transmissive repeller electrode between said positively charged electrode and said luminescent target.

5. A flat-panel display of the type in which a luminescent display screen is scanned by an electron beam, comprising an electron source including a planar hollow-cathode means in which a gas discharge is adapted to be provided, planar electron-transmissive extractor electrode means interposed between said hollow-cathode means and said screen for extracting electrons from a gas discharge in said hollow-cathode means, planar electron-transmissive repeller electrode means interposed between said extractor electrode means and said screen for repelling electrons transmitted through said extractor electrode having less than a predetermined energy level, and means for causing a gas discharge to scan said hollow cathode row by row, whereby said screen is scanned by a beam of electrons emanating from said hollow cathode.

6. A flat-panel display according to claim 5 wherein said extractor and repeller electrodes each comprises a planar conductive member having a plurality of holes therethrough arranged in parallel rows and columns, and said holes in said extractor electrode are in mutual registration with said holes in said repeller electrode.

7. A flat-panel display according to claim 6 wherein said display screen comprises a plurality of luminescent elements arranged in registration with said plurality of holes.

8. A flat-panel display according to claim 7 wherein said hollow cathode comprises a plurality of elongated channels disposed in mutually parallel relationship, said channels being in registration with said holes and said elements.

9. A flat-panel display according to claim 8 wherein one of said channels is provided for each two adjacent rows of said holes.

10. A flat-panel display according to claim 9 comprising a plurality of means respectively provided for each of said rows of holes for selectively preventing the electrons directed into the respective holes from reaching said screen.

11. A flat-panel display according to claim 6 comprising an insulating sheet interposed between said extractor and repeller electrodes, and said insulating sheet having a plurality of holes therethrough arranged in registration with said holes in said extractor and repeller electrodes.

12. A flat-panel display according to claim 11 comprising modulating means interposed between said repeller electrode and said screen for modulating the electron beam transmitted by said repeller electrode.

13. A flat-panel display according to claim 12 comprising means interposed between said modulating means and said screen for accelerating the electrons in said beam.

14. For use in a cathodoluminescent display device of a type wherein a luminescent target is scanned by an electron beam, the combination comprising means including a cathode for generating a gas discharge for use as a source of electrons, an electron-transmissive extraction electrode spaced from said cathode and biased at a positive potential relative to said cathode for extracting electrons from said discharge, an electron-transmissive repeller electrode positioned in proximity to said extractor electrode for intercepting electrons from said source which pass through said extractor electrode, said repeller electrode being biased at a potential which is positive relative to said cathode and negative relative to said extractor electrode, and said extractor and repeller electrodes being spaced from said cathode by a distance substantially less than the mean free path of the electrons from said source, whereby only electrons having at least a predetermined energy level are transmitted by said repeller electrode.

15. The combination set forth in claim 1 wherein said cathode comprises a hollow cathode defining a space in which said gas discharge occurs, and means for causing said gas discharge to migrate in the plane of said hollow cathode.

16. The combination set forth in claim 15 wherein said cathode comprises a plurality of elongated cathode channels arranged in side-by-side parallel relationship.

17. The combination set forth in claim 16 wherein each of said cathode channels comprises a plurality of mutually insulated cathode segments, means for initiating a gas discharge within the space defined by a group of mutually adjacent ones of said cathode segments, and switching means for controlling the potential of said cathode segments to cause said gas discharge to move along the respective channel.

18. The combination set forth in claim 17, wherein each of the cathode segments in the respective cathode channel is electrically connected to corresponding cathode segments in the other of said cathode channels.

19. The combination as set forth in claim 1 comprising a sheet of perforated insulating material interposed between said extractor and repeller electrodes.

20. The combination as set forth in claim 1 comprising a sheet of perforated insulating material interposed between said extractor electrode and said cathode.

* * * * *